US006639159B2

(12) United States Patent
Anzai

(10) Patent No.: US 6,639,159 B2
(45) Date of Patent: Oct. 28, 2003

(54) KEY INPUT CIRCUIT AND PORTABLE TERMINAL INPUT DEVICE

(75) Inventor: Takeshi Anzai, Saitama (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 10/319,136

(22) Filed: Dec. 13, 2002

(65) Prior Publication Data

US 2003/0116419 A1 Jun. 26, 2003

(30) Foreign Application Priority Data

Dec. 14, 2001 (JP) ..... 2001-382132

(51) Int. Cl.[7] ..... H01H 9/54; H01H 13/64

(52) U.S. Cl. ..... 200/1 B; 200/5 A; 200/406; 200/516

(58) Field of Search ..... 200/1 B, 5 A, 200/512–517, 275, 406

(56) References Cited

U.S. PATENT DOCUMENTS

| | | | | | |
|---|---|---|---|---|---|
| 3,973,091 | A | * | 8/1976 | Kaminski | 200/5 A |
| 3,996,429 | A | * | 12/1976 | Chu et al. | 200/5 A |
| 4,376,238 | A | * | 3/1983 | Martin | 200/1 B |
| 4,843,197 | A | * | 6/1989 | Kojima et al. | 200/406 |
| 4,987,275 | A | * | 1/1991 | Miller et al. | 200/5 A |
| 5,510,584 | A | * | 4/1996 | Norris | 200/5 A |
| 5,564,560 | A | * | 10/1996 | Minelli et al. | 200/516 |
| 5,717,176 | A | * | 2/1998 | Dahlstrom | 200/1 B |
| 5,726,400 | A | * | 3/1998 | Masuda | 200/1 R |
| 5,898,147 | A | * | 4/1999 | Domzalski et al. | 200/1 B |
| 6,271,487 | B1 | * | 8/2001 | Domzalski et al. | 200/1 B |
| 6,498,312 | B1 | * | 12/2002 | Villain | 200/406 X |

FOREIGN PATENT DOCUMENTS

| | | |
|---|---|---|
| GB | 2 043 349 A | 10/1980 |
| GB | 2 326 978 A | 1/1999 |
| JP | 7-16339 | 3/1995 |
| JP | 7-262865 | 10/1995 |
| JP | 10-49295 | 2/1998 |
| JP | 2001-56730 | 2/2001 |

OTHER PUBLICATIONS

Search Report from Great Britain Patent Office relating to corresponding Great Britain application No. GB 0229260.5 dated Mar. 26, 2003.

* cited by examiner

*Primary Examiner*—J. R. Scott
(74) *Attorney, Agent, or Firm*—Ostrolenk, Faber, Gerb & Soffen, LLP

(57) ABSTRACT

A key input device for portable terminals and the like, having a reduced sized and improved key input operation. The device has a wiring substrate, multiple keys on the substrate, with each key having three-dimensional displacement surfaces that are displacable in a linked fashion relative to one another. The displacement surfaces have a preceding displacement surface and a succeeding displacement surface corresponding respectively to a preceding and a succeeding key displacement. A first switching operation occurs when a first key part of a first key and first substrate part of the wiring substrate are brought into mechanical contact with each other on the basis of displacement of the preceding displacement surface. A second switching operation results when a second key part of a second key and a second substrate part of the wiring surface are contacted on the basis of displacement of the succeeding displacement surface.

27 Claims, 8 Drawing Sheets

KEY INPUT CIRCUIT AND PORTABLE TERMINAL INPUT DEVICE

BACKGROUND OF THE INVENTION

This application claims benefit of Japanese Patent Application No. 2001-382132 filed on Dec. 14, 2001, the contents of which are incorporated by the reference.

The present invention relates to key input devices and portable terminal input devices and, more particularly, to key input devices and portable terminal input devices, for which it is demanded to reduce size and improve key input operation property as in portable terminals.

CPUs (central processing units) use switches for their operation. To start the operation of microscopic circuits of the CPU, macroscopic mechanical switches are necessary. Switches which prescribe the operational conditions of PCs (personal computers) are usually referred to as keys. A key board is provided to the PC in a steady-state fashion. The number of keys provided in the keyboard is the sum of the number of alphabet letter keys, the number of function keys, the number of numeral keys and the number of other additional function keys. This sum is more than 100. For key-less operation of the CPU, a key called mouse is used.

In portable telephone sets, such a number of keys can not be practically disposed. Not only for portable telephone sets but also for many other electronic devices, it is demanded to reduce the number of keys prescribing the operation start condition of their CPU. Particularly, for portable electronic devices for which size reduction is demanded, not only the key number reduction but also the physical size reduction of keys is demanded. From the standpoints of practical merits and usefulness, such size reduction should not result in deterioration of the mechanical and physical performance of the mechanical switches. As for the mechanical and physical performance, both the reliability of switching function and the reliable transmission of operation sense such as that called click sense.

As switch having these two different kinds of performance, a sheet switch is well known in the art, in which a group of switches is formed in a sheet-like arrangement. The sheet switch is excellent in its displacing and restoring properties. FIGS. 13(*a*) to 13(*c*) show a unit switch or unit key (or key element), which is reduced in size but is excellent in the two different kinds of performance. This unit switch is called dome-like switch. As shown in FIG. 13(*a*), this well-known unit key has two electrodes, i.e., an annular thin film electrode 101 and a dot-like thin film electrode 102. The annular and dot-like thin film electrodes 101 and 102 are both formed on an electrode substrate (not shown) having a multiple sub-layer wiring layer. The annular and dot-like thin film electrodes 101 and 102 are connected to lead lines of wiring, which is formed three-dimensionally inside the multiple sub-layer wiring layer. FIG. 13(*c*) shows a movable switching element. This switching element is formed as a semi-spherical shell-like thin metal sheet member 103. In lieu of the thin metal sheet member 103, it is possible to use a semi-spherical shell-like elastomer resin member, which has an electrically conductive film bonded to its inner surface. In FIG. 13(*c*), the thin metal sheet member 103 is shown such that its top part has been pushed down. As a result of pushing down the top part, the inner surface thereof is brought into contact with the dot-like thin film electrode 102, and an equivalent switching circuit 104 as shown in FIG. 14 is turned on.

In the well-known dome-like switch, which is excellent in the two different kinds of performance as noted above, i.e., the reliability of switching function and an transmission of operation sense. One operation made manually corresponds to one electronic switching operation. Such one-to-one correspondence is excellent in regard of mechanical relay function between person and CPU. It is demanded to reduce the key number by one-to-plurality correspondence while preserving the excellent mechanical relay function between man and CPU.

As switch which is capable of executing a plurality of switching functions by selecting a plurality of positions in response to one manual operation owing to one-to-plurality correspondence, many switches having different mechanical structures are well known in the art as shown in, for instance, Japanese Utility Model Laid-Open No. 7-16339, Japanese Patent Laid-Open No. 7-262865, Japanese Patent Laid-Open No. 2001-56730 and Japanese Patent Laid-Open No. 10-49295. In portable telephone set PCs having a switch group formed by a number of witch elements, it is demanded that the individual switch elements are formed in small size and reliably operable, it is essentially demanded to reduce the area necessary for the circuit structure including the switches, and it is further demanded that instantaneous operation is possible. Particularly, it is thought to be important that reliable transmission of operation sense, permitting confirmation of switching operation during the operation of depressing a switch, is realized.

SUMMARY OF THE INVENTION

The present invention has an object of providing an input device and a portable terminal input device, in which excellent mechanical relay function between person and CPU is preserved, many small key elements are disposed collectively as a group, reliable property of operation sense transmission permitting confirmation of switching operation is realized, and consequently it is possible to reduce the number of keys owing to one-to-plurality correspondence.

Means for attaining the above object are expressed as follows. To technical items in the expression are annexed numerals, symbols, etc. in parenthesis. These numerals, symbols, etc. are identical with reference numerals, symbols, etc. attached to technical items in a plurality of embodiments or one or more embodiments there among according to the present invention, particularly to technical items expressed in the embodiments or drawings corresponding thereto. Such reference numerals, symbols, etc. clarify the correspondence or mediation between technical items set forth in claims and technical items in the embodiments. Such correspondence or mediation does not mean that the technical items as set forth in claims are to be interpreted as being limited to the technical items in the embodiments.

A key input device according to the present invention comprises a wiring substrate (2); and a plurality of keys (1) disposed on the wiring substrate (2) and each having three-dimensional displacement surfaces capable of being displaced in a linked fashion relative to one another. The three-dimensional displacement surfaces comprises a preceding displacement surface capable of undergoing a first displacement preceding in time; and a succeeding displacement surface capable of undergoing a second displacement subsequent in time to the first displacement of the preceding displacement surface. The succeeding displacement surface is capable of undergoing the second displacement by a displacing force of the first displacement. The plurality of keys (1) each have a first key (3) forming the preceding displacement surface; and a second key (4) having the succeeding displacement surface. A first switching operation is brought about when a first key (1) part of the first key (1) and a first substrate part (12, 43) of the wiring substrate are brought into mechanical contact with each other on the basis of displacement of the preceding displacement surface. A second switching operation is brought about when a second key part of the second key (4) and a second substrate part (13, 46) of the wiring substrate (2) are brought into mechanical contact with each other on the basis of displacement of the succeeding displacement surface. Each of the keys (1) executes the first and second switching operations by movement of its part perpendicular to the substrate (2) surface of the wiring substrate.

It is particularly important that the preceding and succeeding displacement surfaces both form, before displacement, surfaces convex in a direction opposite to the direction of movement. A change from convex surface before displacement to concave surface after displacement, physically means that an upper dead center is present during the progress of displacement. At the time of passing the upper dead center, reliable transmission of an operation sense permitting confirmation of a switching operation can be reliably obtained in view of sense. Consequently, a plurality of steps of click senses are obtained in a linked fashion, while the number of keys 5 can be reduced. The number of steps is not limited to two, but a triple-wall dome-like form permits three-step click sense to be obtained in a linked fashion.

A single key has two operating surfaces, i.e., a preceding and a succeeding displacement surface, and when it receives a single external force exerted in a single direction, it can execute two switching operations self-matchingly and in a linked fashion. Such a key structure is capable of making a double action although it is actually a single switch, thus actually permitting the reduction of the number of switches or keys to one half and also permitting manual operation speed increase. One key can serve as two keys and is operable as one function key.

The common attaining means described above for realizing the double action, is realized by the following two attaining means. The first and second keys (3) and (4) are geometrically related one outside the other. In a first attaining means, the first and second keys (3) and (4) are spaced apart in a direction perpendicular to the substrate surface of the wiring substrate (2), and the first key (3) is disposed outside the second key (4) with respect to the wiring substrate surface. In a special case, the second key (4) is found in a closed space defined by the first key (3) and the wiring substrate (2). In a second attaining means, the first and second keys (3) and (4) are spaced apart in a direction parallel to the substrate surface of the wiring substrate (2). The second key (2) is enclosed in the first key (3), and is disposed to be continuous to and connected to the inner side of the first key (3). The first and second keys (3) and (4) and the wiring substrate (2) form a single closed space.

A First Solving Means

The first switching operation is brought about when the first key part and the first substrate part (12) of the wiring substrate (2) are brought into contact via the second key part with each other. The first key (3), the wiring substrate (2) and the second key (4) together form a first closed space. The second key (4) and the wiring substrate (2) together form a second closed space. The second key (4) is within a third space formed by the first key (3) and the wiring substrate (2). As shown, the first key (3) causes displacement and deformation of the second key (4) in the third closed space.

The wiring substrate (2) has a first electrode (12) fixedly bonded to the first key (3), a second electrode (13) fixedly bonded to the second key (4), and a third electrode (14) facing the second closed space. The first substrate part (13) corresponds to the second electrode (13) and the second substrate part (14) corresponds to the third electrode. The first electrode (12) forms a first closed ring, and the second electrode (13) forms a second closed ring. The first key (3) has its entire circumference bonded to the first ring, the second key (4) has its entire circumference bonded to the second ring, the first ring is electrically connected to GND (23), the second ring is connected to a first input port (24) of a CPU (central processing unit), and the third electrode (14) is connected to a second input port (25) of the CPU. With the double action, the CPU is operable in two different ways.

Here, the first key (3) has an electrically conductive first inner surface, the first inner surface is electrically connected to the first electrode (12), the second key (4) has an electrically conductive second inner surface, and the second inner surface is electrically connected to the second electrode (13). This is clearly understandable from the circuit construction even without any clear description. The inventive step is not given by the above, but is merely mentioned for the description.

The first key (3) has a first body part made of a resin and a first electrically conductive film formed on the inner side of the first body part. The first inner surface corresponds to the inner surface of the first electrically conductive film (not shown) . The second key (4) has a second body part made of a resin and a second electrically conductive film (not shown) formed on the inner side of the second body part. The second inner surface corresponding to the inner surface of the second electrically conductive film. Such multiple layer key structure is practically useful in view of both the electric conductivity and the flexible deformation property. As copper alloy thin films and aluminum alloy thin films, those which can widthstand 10,000,000 times of folding have been developed and practically useful. On the other hand, a multiple layer structure constituted by resin and electrically conductive films is excellent in the mass production property. It is possible to form keys from the sole electrically conductive resin. In the case of using resin, it is possible to assemble together keys and wiring substrate close-contact-wise and high and mass production manners by insert injection molding techniques.

The wiring substrate (2) has a plurality of lead lines formed in its inside and either one of the first to third electrodes is electrically connected via a connecting lead (17) extending perpendicular to the wiring substrate to the wiring. The more the number of function keys, the higher effect of reducing the circuit area with the multiple layer wiring substrate is obtainable.

The first and second keys (3), (4) are both especially preferably semi-spherical shell-like in form. While the key movement direction may be a single direction, since the key is semi-spherical shell-like in form, the single direction can freely follow the direction of push-down of a man's finger. The first and second keys (3), (4) are both frust-conical in form. Generally, it is important to provide a dome-like form like the well-known dome-like switch.

Second Solving Means

The preceding and succeeding displacement surfaces form a continuous displacement surface, and the continuous displacement surface and the substrate (2) surface of the wiring substrate form a single closed space. The wiring substrate (2) has a first lead line having a first disconnected part (43), and a second lead line having a second disconnected part (46). The first and second key parts (35), (37) are both electrically conductive, the first switching operation is brought about when the first key part (35) is electrically coupled to the first disconnected part (43, 44, 45), and the second switching operation is brought about when the second key part (37) is electrically coupled to the second disconnected part (46, 47, 48). The first lead line has one side (44) electrically connected to the ground (23) and the other side (45) connected to the first input port (25) of the CPU, and the second lead line (47) has one side (48) electrically connected to the ground (23) and the other side (47) connected to the second input port (24) of the CPU. The first key (3) has a first frust-conical form part (31) having a larger outer diameter and a first disk-like part (32) integral with the first frust-conical form part (31) and substantially parallel to the wiring substrate surface. The second key (4) has a second frust-conical form part (33) having a smaller outer diameter and a second disk-like part (34) integral with the second frust-conical form part (33) and substantially parallel to the wiring substrate surface. The first disk-like part (32) is integral with the second frust-conical form part (33). The first key part (35) is formed on the first disk-like part (32), and the second key part (37) is formed on the second disk-like part (32).

More specifically, the first key (3) has a first partly spherical shell-like part (51) having a larger outer diameter and a second partly spherical shell-like part (52) having a smaller outer diameter. The first partly spherical shell-like part (51) is continuous to and integral with the second partly spherical shell-like part (52). The first lead line has a first one side disconnected part (44) formed in a first one side concave part and also has a first other side disconnected part (45) formed in a first other side concave part. The first one side disconnected part (44) has a portion extending in the first other side concave part, and the first other side disconnected part having a portion extending in the first one side concave part. The second lead line has a second one side disconnected part (48) formed in a second one side concave part and also has a second other side disconnected part (47) formed in a second other side concave part. The second one side disconnected part (48) having a portion extending in the second one side disconnected part, and the second other sided is connected part (47) having a portion extending in the second one side concave part. Such a structure makes reliable electrical connection. The surfaces (36), (38) of the first and second key parts (35), (37) are both preferably smoothly curved surfaces.

The input device for a portable terminal according to the present invention comprises a casing (not shown), a CPU keyboard (not shown) disposed within the casing and having a CPU, a key group movably supported on the casing and constituted by a plurality of keys (1) formed as elements on the outer surface of the casing, and a wiring substrate (2) having a plurality of electrodes supported on the casing such as to be capable of being contacted by the keys (1). The movement of each key (1) is a reciprocal movement having components in a perpendicular direction to the outer surface. The key (1) is brought into contact with electrodes (13 and 14, or 47 and 46) by two-step contact in a forward stroke in the perpendicular direction. The second contact in the two-step contact is a mechanically essential condition for the first contact of the two-step contact. The two-step contact switches the voltage states of the two input ports of the CPU in a linked fashion.

The electric two-step contact of the double action, permits reducing the input device of the portable terminal device, increasing the speed of the input operation and smoother input operation of highly functional digital portable telephone sets that will appear in the future. More specifically, the first step contact corresponds to numeral "j" of a numeral key, and the second step contact corresponds to numeral "j+1" of the numeral key. If the minimum value of the numeral "j" is "0", the second step contact corresponds to an odd numeral of the numeral key. There are many program start linked functions of starting one operation by inputting two electric signals to the CPU. In such case, the user can start the program with a single action.

The keys (1) each have a first function key, a second function key, shallow push-down of the first function key causes start of a function f·1, shallow push-down of the second function key causes start of a function f·2, and deep push-down of the first function key causes start of a function f·3 corresponding to the shallow push-down of the first function key and the shallow push-down of the second function key. The operations of these linked fashion are made fast.

Other objects and features will be clarified from the following description with reference to attached drawings.

PREFERRED EMBODIMENTS OF THE INVENTION

Preferred embodiments of the present invention will now be described with reference to the drawings.

Figure 1:
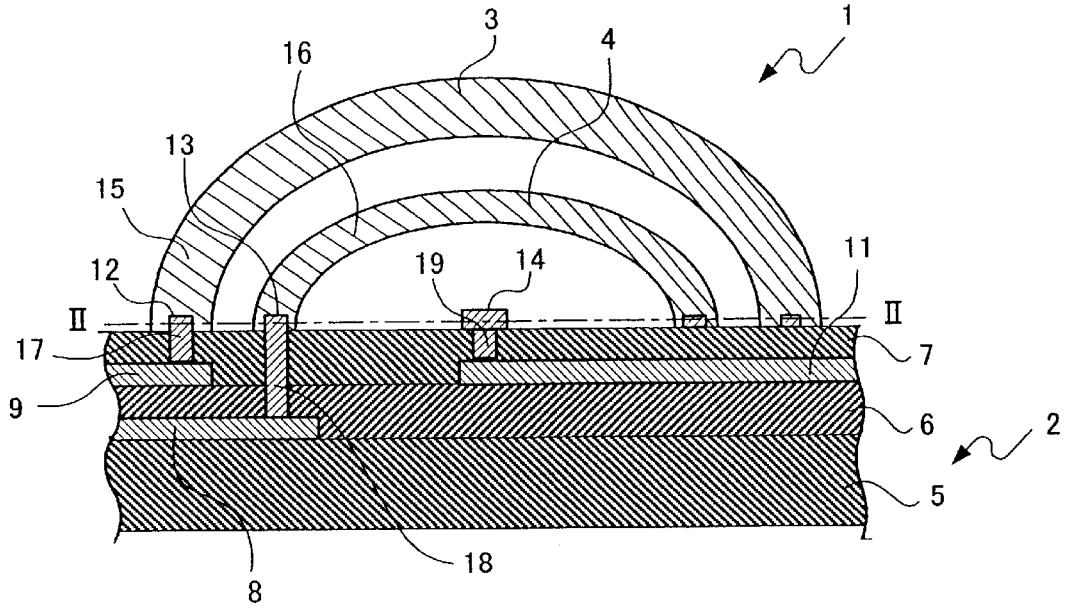
FIG. 1 shows a sectional view of an input key circuit according to the present invention.

Referring to the drawings, an embodiment of the key input device according to the present invention uses a multiple layer wiring substrate together with a three-dimensional continuous displacement member. As shown in FIG. 1, the three-dimensional continuous displacement member 1 is formed three-dimensionally on top of the multiple layer wiring substrate 2. The three-dimensional continuous displacement member 1 has a sort of double-wall structure constituted by an outer and an inner three-dimensional continuous displacement parts 3 and 4. In this embodiment, the outer three-dimensional continuous displacement part 3 is in the form of a semi-spherical shell-like (or dome-like) electrically conductive thin layer.

The outer three-dimensional continuous displacement part 3 is formed from a material, which is adequately rigid and adequately elastic shell-like aluminum alloy thin sheet. In lieu of the aluminum alloy thin sheet member, it is possible to use a double-wall shell member constituted by an outer shell-like part of an elastomer resin and an inner shell-like part of an electrically conductive resin. The inner three-dimensional continuous displacement part 4 is again in the form of a semi-spherical shell-like electrically conductive thin layer. The inner three-dimensional continuous displacement part 4 is formed from a material, which is again adequately rigid and adequately elastic shell-like aluminum alloy thin sheet. Again in lieu of the aluminum alloy thin sheet member, it is possible to use a double-wall shell-like member constituted by an outer shell-like part of an elastomer resin and an inner shell-like part of an electrically conductive resin.

The outer three-dimensional continuous displacement part 3 and the multiple layer wiring substrate 2 together define a closed space. The closed space means that neither dust particles nor rain water will intrude into the outer three-dimensional continuous elastomer part 3. The outer and inner three-dimensional continuous displacement parts 3 and 4 together define a first closed space between them. The inner three-dimensional continuous displacement part 4 and the multiple layer wiring substrate 2 together define a second closed space. The second closed space means that neither dust particles nor rain water will intrude into the outer three-dimensional continuous displacement part 3.

The outer and inner three-dimensional continuous displacement parts 3 and 4 are in concentric disposition. The outer and inner three-dimensional continuous displacement parts 3 and 4 have a three-dimensional displacement property, which is a geometrical property that the angles between given parts of the inner and outer surfaces and parts adjacent to these parts are variable. The outer and inner three-dimensional continuous displacement parts 3 and 4 are formed such as to be symmetrical with respect to their center line.

The multiple layer wiring substrate 2 is constituted by a switch substrate 5, a first wiring layer 6 formed atop the switch substrate 5 and a second wiring layer 7 formed atop the first wiring layer 6. A first wiring 8 is formed atop the switch substrate 5 such that it is buried in the first wiring layer 6. A second and a third wiring 9 and 11 are formed atop the first wiring layer 8 such that they are buried in the second wiring layer 7. A first to a third electrode 12 to 14 are formed atop the second wiring layer 7. The first electrode 12 is buried in an outer annular stem part 15 of the outer three-dimensional continuous displacement part 3. The second electrode 13 is buried in an inner annular stem part 16 of the inner three-dimensional continuous displacement part 4.

Figure 2:
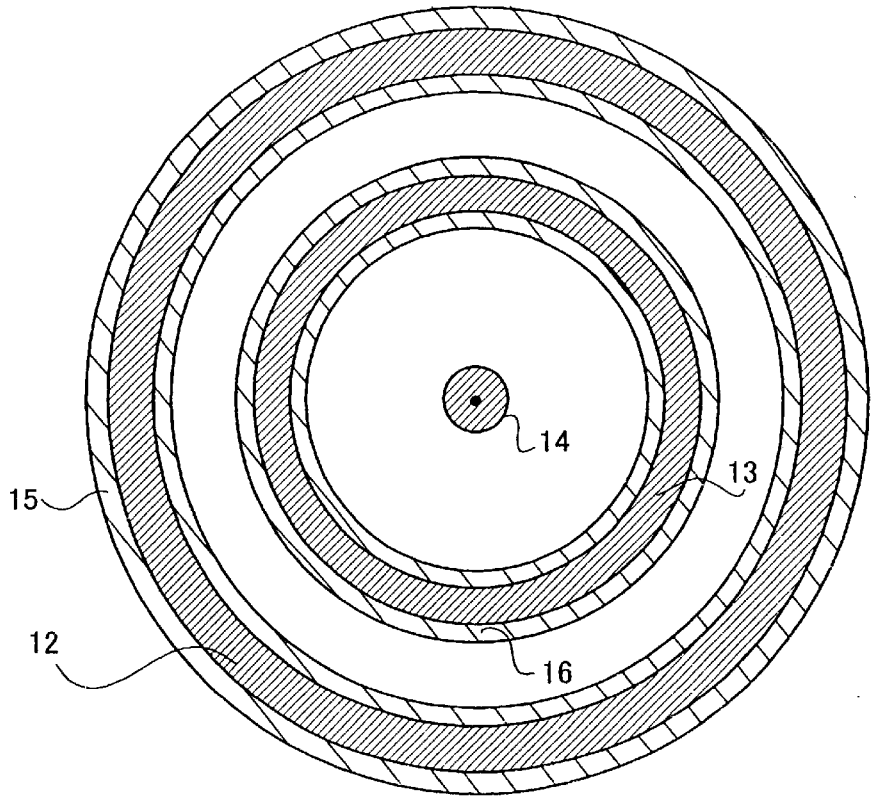
FIG. 2 shows a sectional view along the line I–II in FIG. 1.

As shown in FIG. 2, the first electrode 12 forms an outer annular electrode, and the second electrode 13 forms an inner annular electrode. The third electrode 14 forms a round electrode. The first and second electrodes 12 and 13 have a common central circular area, in which the third electrode 14 is positioned. The first electrode 12 is connected via a first lead line 7, which penetrates the second wiring layer 7 in a direction perpendicular to the substrate surface, to the second wiring 9. The second electrode 13 is connected via a second lead line 18, which penetrates the second and first wiring layers 7 and 6 in a direction perpendicular thereto, to the first wiring 8. The third electrode 14 is connected via a third lead line 19, which penetrates the second wiring layer 7 in a direction perpendicular thereto, to the third wiring 11.

Figure 3:
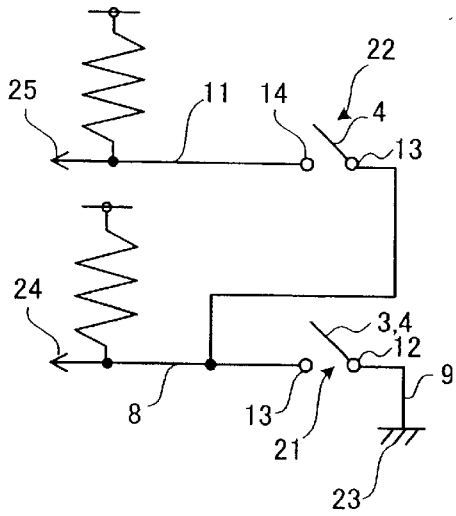
FIG. 3 shows an equivalent circuit of the embodiment shown in FIG. 1.

FIG. 3 shows an equivalent circuit of the embodiment of the present invention employed in a portable terminal input device. The three-dimensional continuous displacement member 1 and the multiple layer wiring substrate 2 together form a wiring circuit, which is equivalent to the circuit shown in FIG. 3. As shown in FIG. 3, the outer and inner three-dimensional continuous displacement parts 3 and 4 together form a first switch 21 for selecting the turning-on or -off of the first and second electrodes 12 and 13 with respect to each other, and the inner three-dimensional continuous displacement part 4 forms a second switch 22 for selecting the turning-on or -off of the second and third electrodes 13 and 14 with respect to each other.

The first electrode 12 is connected to GND (ground) 23. The second electrode 13 is connected via the first wiring 8 to a first input port 24 of a CPU (not shown), so that the CPU is capable of reading out data at an H (high) or an L (low) level. The first input port 24 is pulled up to an H level voltage. The third electrode 14 is connected via the third wiring 11 to a second input port 25 of the CPU, so that the CPU is capable of reading out data at the H or L level. The second input port is pulled up to the H level voltage.

Figure 4:
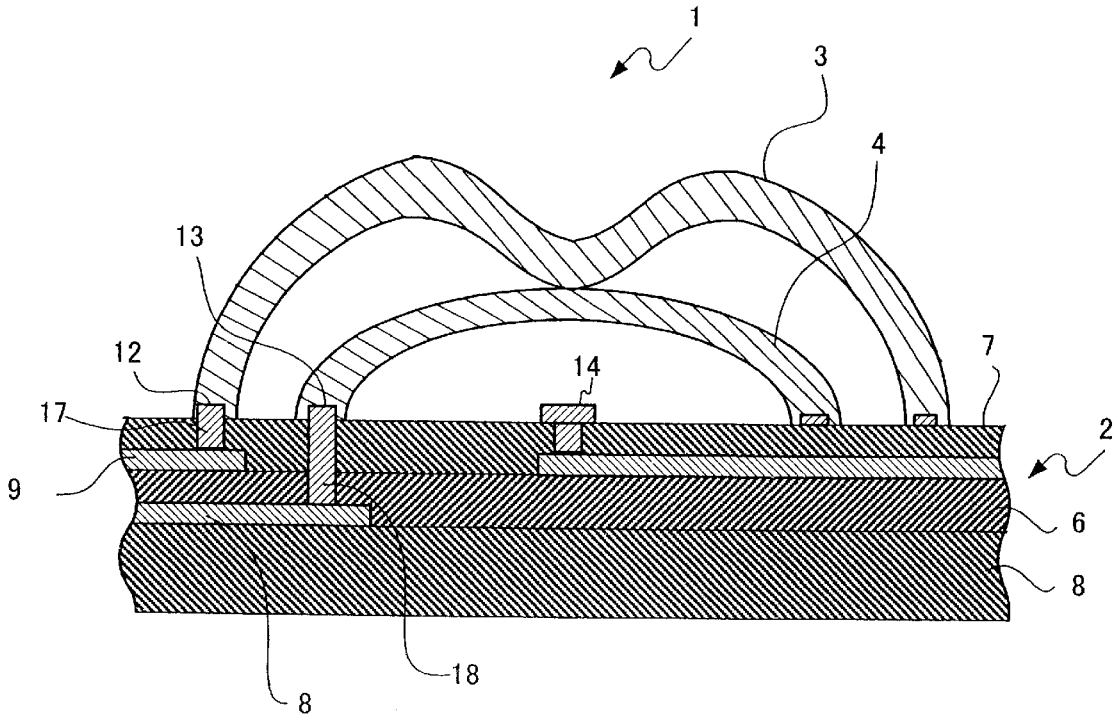
FIG. 4 shows a sectional view of the embodiment shown in FIG. 1 in a succeeding operation.

FIG. 4 shows the operation of the first switch 21 with push-down of the outer three-dimensional continuous displacement part 3. When the convex top part of the outer three-dimensional continuous displacement part 3 is pushed down toward the substrate side, the convex inner surface (i.e., lower, back or substrate side surface) of the convex top part of the outer three-dimensional continuous displacement part 3 is mechanically brought into contact in a surface-like area with a convex outer surface (i.e., upper front surface) of the inner three-dimensional continuous displacement part 4. With the outer and inner three-dimensional continuous displacement parts 3 and 4 mechanically brought into contact with each other, the first and second wirings 8 and 9 are electrically conductively connected to each other. This electrically conductive state corresponds to the "on" state of the first switch 21 shown in FIG. 3.

Figure 5:
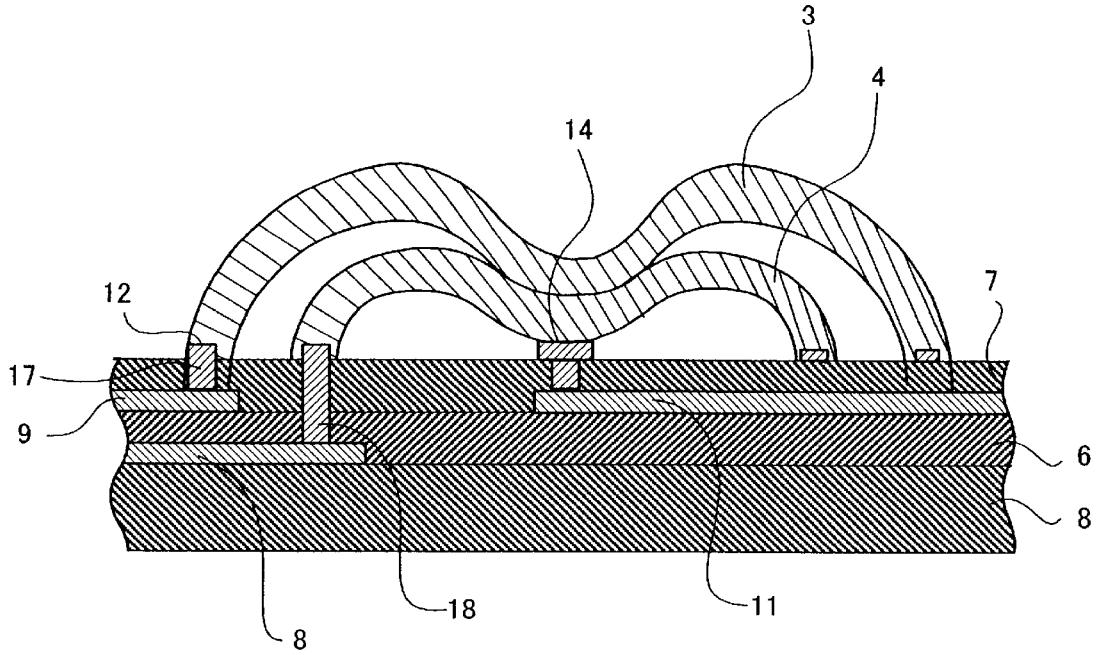
FIG. 5 shows a sectional view of the embodiment shown in FIG. 4 in a succeeding operation.

FIG. 5 shows the operation of the first and second switches 21 and 22 with simultaneous push-down of the outer and inner three-dimensional continuous displacement parts 3 and 4. As the convex top part of the outer three-dimensional continuous displacement part 3 is pushed down and deformed, its concave inner surface is mechanically brought into contact with the convex outer surface of the convex top part of the inner three-dimensional continuous displacement part 4 (see FIG. 4). With this mechanical contact, the first switch 21 is brought to the conductive, i.e., "on", state as described before. As the top part of the outer three-dimensional continuous displacement part 3, having been pushed down and deformed and displaced to become concave, is continually pushed down, the convex top part of the inner three-dimensional continuous displacement part 4 is deformed to become convex and displaced by the top part, now convex, of the outer three-dimensional continuous displacement part 3. Eventually, the convex inner surface (i.e., lower surface) of the convex top part of the inner three-dimensional continuous displacement part 4 is mechanically brought into contact with the top of the third electrode 14.

With the inner three-dimensional continuous displacement part 4 and the third electrode 14 mechanically brought into contact with each other, the third and second electrodes 14 and 13 are electrically conductively connected to each other to obtain electric connection of the third wiring 11 and the third electrode 14 to each other. This electrically conductive state, i.e., electric connection of the third electrode 14 to the third wiring 11, corresponds to the "on" state of the second switch 22 shown in FIG. 3. The first switch 21 is always in the "on" state so long as the second switch is in the "on" state. The "on" state of the first switch 21 is an essential condition for the "on" state of the second witch 22.

The entirety of the inner surface of the outer three-dimensional continuous displacement part 3 constitutes a preceding displacement surface, which undergoes preceding displacement. Deforming force of the preceding displacement surface causes deformation of a succeeding displacement surface, which is the outer surface of the outer three-dimensional continuous displacement part 3. Such deformation can be caused by manually pushing operation. The user can make either one of two different pushing operations. That is, (1) first pushing operation, and (2) linked pushing operation, in which the first pushing operation is linked with a second pushing operation continually executed subsequent to the first pushing operation.

The first pushing operation is in one-to-one correspondence to the first switching operation of the first switch. The second pushing operation is in one-to-one correspondence to the second switching operation of the second switch. The linked pushing operation corresponds to both the first and second switching operations. Actually, the linked pushing operation is a single operation. The single linked pushing operation is in one-to-two correspondence to the first and second switching operations.

The outer and inner three-dimensional continuous displacement parts 3 and 4, which permit such linked pushing operation, are disposed in parallel in the direction perpendicular to the substrate surface. That is, these parts 3 and 4 do not occupy a substrate area corresponding to two elements, but they occupy a substrate area corresponding to a single element. Regarding the operation of home electric products, Kohnosuke Matsushita mentions the following. "The housewife becomes soon accustomed to up to two serial operations, but it is difficult for her to smoothly do three serial operations. For example, the housewife can readily connect power supply to a TV by pulling a switch knob and then continually turn the knob for sound volume adjustment, but it is difficult for her to further turn down the knob for TV screen brightness adjustment." A linked action for uni-dimensional motion of a first and a second push-down, is very ready for recent young persons who are accustomed to game operations. It is particularly preferred to give, by providing a sense of click between the first and second push-down operations, a sense of sensual operational distinction between the first push-down operation and the linked operation. In the dome-like switch described above, a click sense is obviously generated for the first time at the upper dead center in the transition from the restored state as shown in FIG. 1 to the state after the first push-down operation as shown in FIG. 4.

Figure 6:
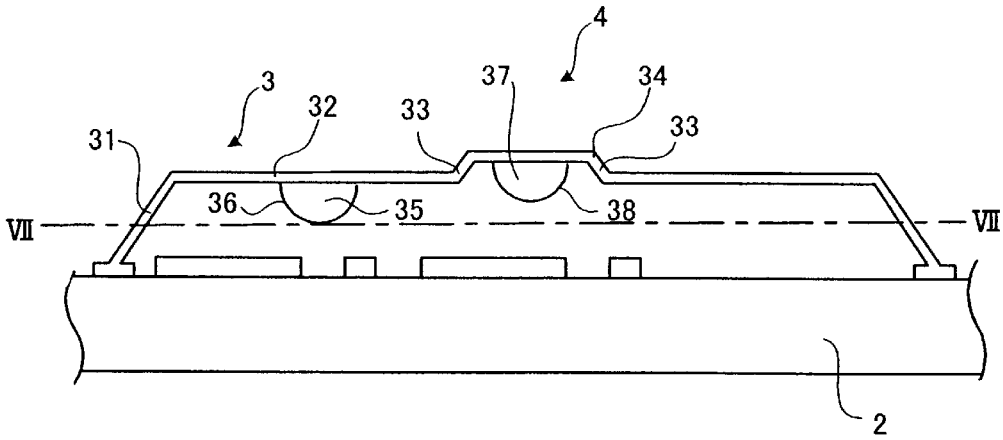
FIG. 6 shows a different embodiment of the key input device according to the present invention.

FIG. 6 shows a different embodiment of the key input device according to the present invention. This embodiment seeks to clarify the generation of a first and a second click senses. The dome-like switch in this embodiment is not in the double-wall semi-spherical shell form as described before but in a single-wall two-step bent form. This dome-like semi-spherical shell form dome-like three-dimensional continuous displacement member l is disposed atop multiple layer wiring substrate 2.

As shown in FIG. 6, the three-dimensional continuous displacement part 1 is formed three-dimensionally atop the multiple layer wiring substrate 2. The three-dimensional continuous displacement member 1 is constituted by outer and inner three-dimensional continuous displacement parts 3 and 4. While in the preceding embodiment the outer and inner three-dimensional continuous displacement parts 3 and 4 are overlappedly disposed one above another in the direction perpendicular to the substrate surface, in this embodiment the outer and inner three-dimensional continuous displacement parts 3 and 4 are in a concentric planar disposition one inside another and in parallel to the substrate surface. As described before, the outer and inner three-dimensional continuous displacement parts 3 and 4 are made of metal or resin.

The outer three-dimensional continuous displacement part 3 is constituted by a frust-conical part 31 having a larger outer diameter and a large-diameter disk-like part 32, which is integral with the frust-conical part 31 and parallel to the substrate surface. The large-diameter disk-like part 32 has a central hole or opening occupying a central area. The inner three-dimensional continuous displacement part 4 is constituted by a frust-conical part 33 having a smaller outer diameter and a small-diameter disk-like part 34, which is integral with the frust-conical part 33 and parallel to the substrate surface.

The large-diameter disk-like part 32 is integral with the frust-conical part 33. The frust-conical part 31, the large-diameter disk-like part 32, the frust-conical part 33 and the small-diameter disk-like part 34 are all made of an insulating material. The large-diameter disk-like part 32 has a first electrically conductive contact 35 bonded to a particular part of its lower surface. The first electrically conductive contact 35 has a first electric contact surface 35, which is downwardly gently convex in shape. The small-diameter disk-like part 34 has a second electrically conductive contact 37 bonded to a central part of its lower surface. The second electrically conductive contact 34 has a second electric contact surface 38, which is downwardly gently convex in shape.

Figure 7:
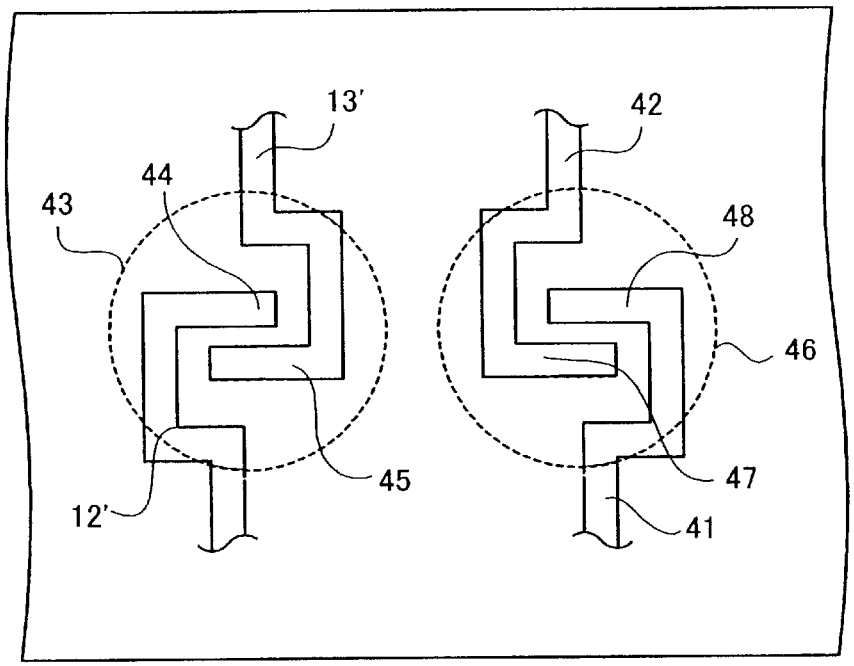
FIG. 7 shows a sectional view along the line VII–VII in FIG. 6.

FIG. 7 shows the disposition of electrodes formed on the top surface of the multiple layer wiring substrate 2. These electrodes are constituted by a first and a second electrode 12' and 13' as a pair and a third and a fourth electrode 41 and 42 also as a pair. The first and second electrodes 12' and 13' are formed such that they are disconnected from each other, but they have first proximity parts 44 and 45, respectively, which are proximate to each other in a first particular circular area 43. The third and fourth electrodes 41 and 42 are formed such that they are disconnected from each other, but they have proximate parts 47 and 48, respectively, which are proximate to each other in a second particular circular areas 46.

The first proximity parts 44 and 45 in the first particular circular area 43 are both bent in a concave (or complicated) fashion, and they each partly extend in a convex area of the other. The second proximity parts 47 and 48 in the second particular circular area 46 are both bent in a concave (or complicated) fashion, and they partly extend in a convex area of the other.

Figure 8:
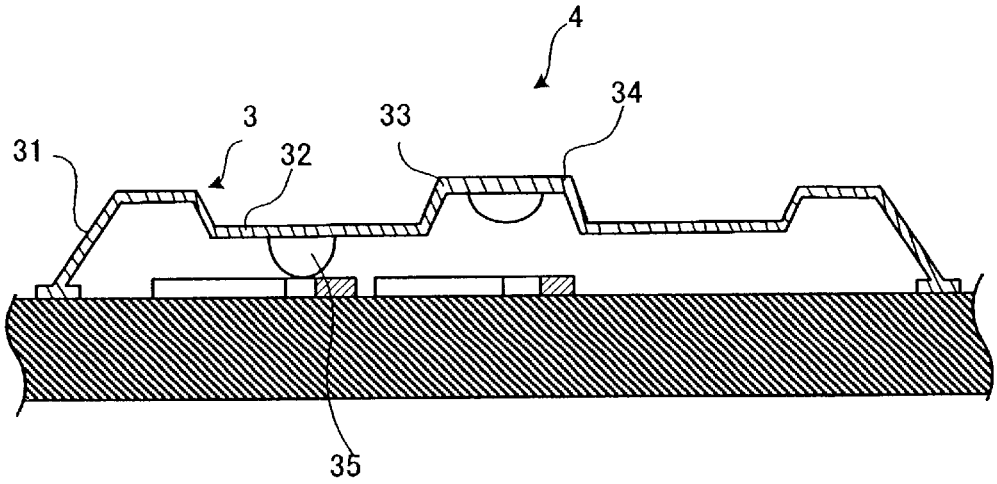
FIG. 8 shows a sectional view of the embodiment shown in FIG. 6 in a succeeding operation.
Figure 10:
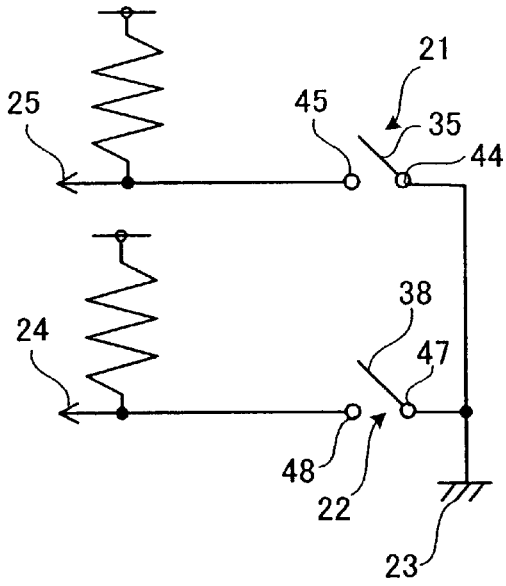
FIG. 10 shows an equivalent circuit of that shown in FIG. 6.

FIG. 8 shows the switching operation of the first switch 1 caused by the first push-down operation. When the central small-diameter disk-like part 34 of the three-dimensional continuous displacement member 1 is pushed down, the outer three-dimensional continuous displacement part 3, which is integral with the small-diameter disk-like part 34, is pushed down. By receiving such pushing-down force, a circumferential area adjacent to the outer side of the large-diameter disk-like part 32 becomes a readily foldable area, and most part of the large-diameter disk-like part 32 collapses (subsides) in unison with the small-diameter disk-like part 34 into a form just like a crates of a caldera. With this collapse (subsidence), the first electrically conductive contact 35 bonded to the lower surface of the large-diameter disk-like part 32, is brought into contact with both the first proximity parts 44 and 45, which are found in the proximity of each other within the first particular circular area 43 shown in FIG. 7. With this linked contact of the first electrically conductive contact 35 with the first proximity parts 44 and 45, the first switch is brought to the "on" state as shown in FIG. 10.

Figure 9:
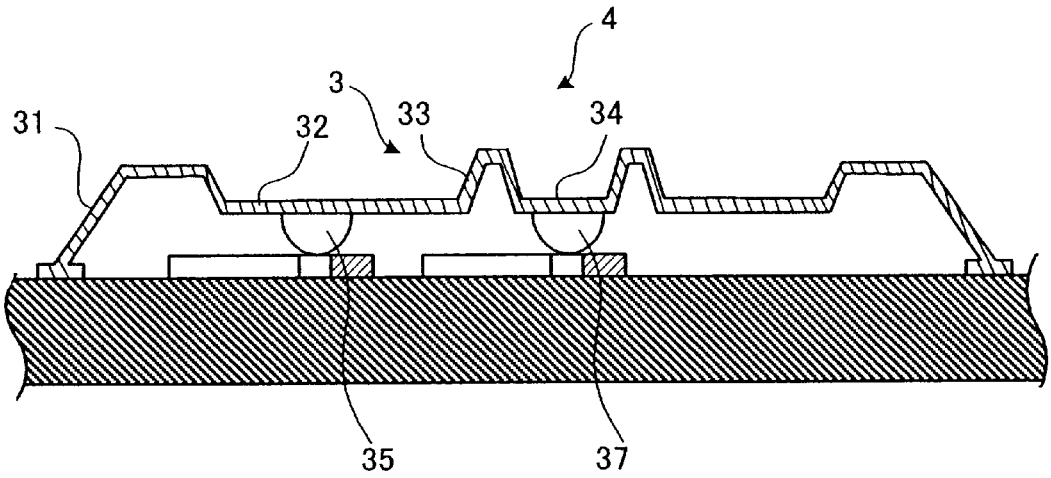
FIG. 9 shows a sectional view of the embodiment shown in FIG. 8 in a succeeding operation.

FIG. 9 shows the switching operation of the second switch 22 caused by the second push-down operation. As the small-diameter disk-like part 34 is continually pushed down, a circumferential area adjacent to the outer side of the small-diameter circular part 34 thus becomes a readily foldable area, and the small-diameter disk-like part 34 further collapses (subside) with respect to the large-diameter disk-like part 32, which now can no longer be pushed down, to assume a form just like a crates of a caldera. As a result, the second electrically conductive contact 37 formed on the lower surface of the small-diameter disk-like part 34 is brought into contact with both the proximity parts 47 and 48, which are found to be in the proximity of each other within the second particular circular area shown in FIG. 7. With this linked contact of the second electrically conductive contact 38 with the proximity parts 47 and 48, the second switch 22 is brought to the "on" state as shown in FIG. 10. As shown in FIG. 10, the first and second proximity parts 44 and 47 are both connected to the common GND 23.

Like the previous embodiment, the "on" state of the first switch 21 is the essential condition of the "on" state of the second switch 22. The first push-down operation is in one-to-one correspondence to the first switching operation of the first switch. The second push-down operation is in one-to-one correspondence to the second switching operation of the second switch. The linked push-down operation corresponds to the first and second switching operations. The linked push-down operation is actually a single operation. The single linked push-down operation is in one-to-two correspondence to the first and second switching operations.

The drawing expression which clarifies the first and second collapses in this embodiment, clarifies the presence of the first and second click senses. As shown in FIGS. 4 and 5, the smooth bending of the outer and inner three-dimensional continuous displacement parts 3 and 4 is strongly dependent on the material thereof. In the case of the semi-spherical shell form, it is preferred to form the central part of the dome to be relatively thin compared to the outer side. By so doing, more satisfactory collapsing (subsidence) deformation is obtainable, and also the elastic durability concerning the restoration can be improved.

Figure 11:
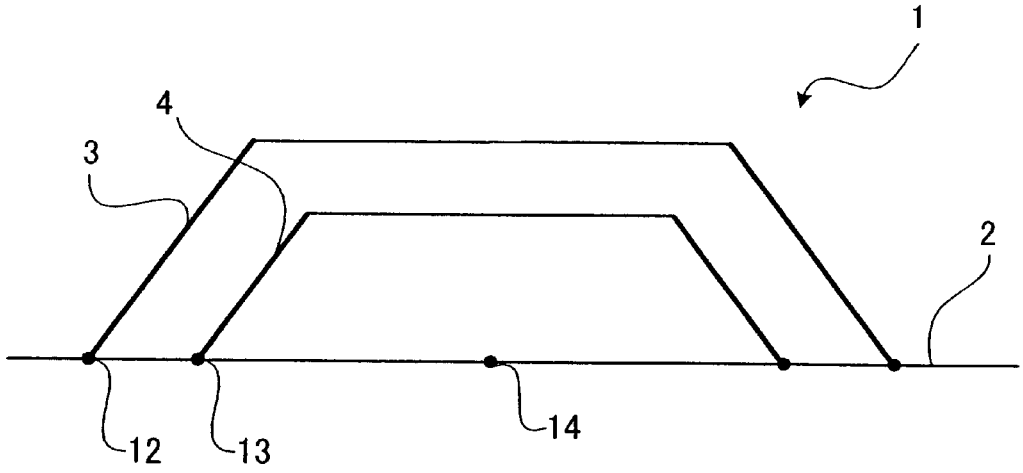
FIG. 11 shows a sectional view of an input key circuit according to other embodiment of the present invention.
Figure 12:
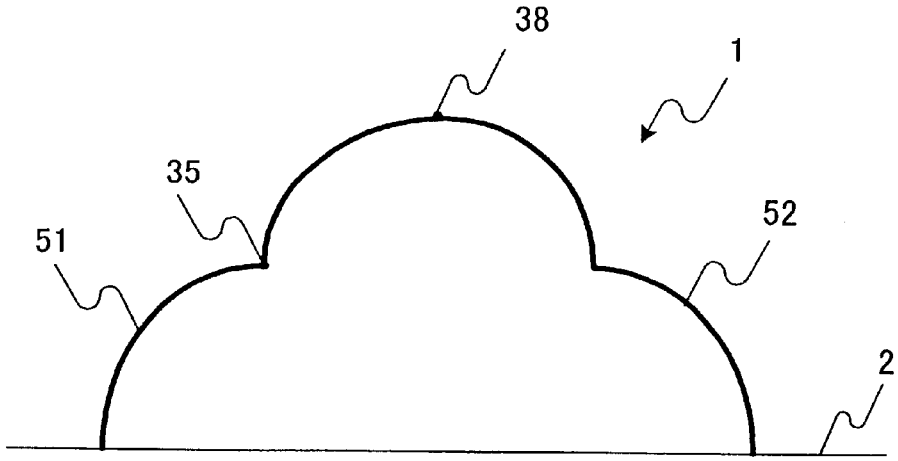
FIG. 12 shows a sectional view of an input key circuit according to further embodiment of the present invention.
Figure 13A:
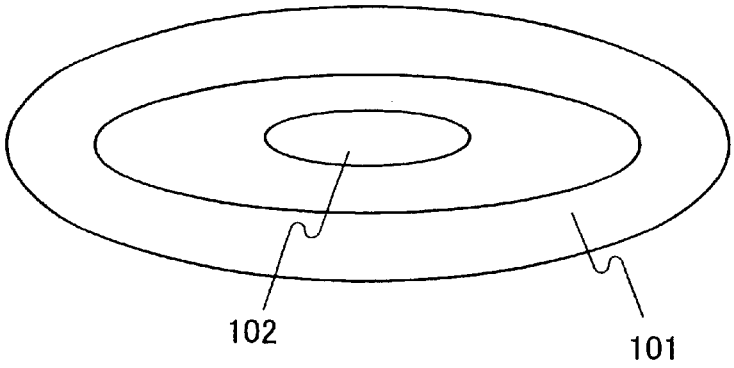
FIG.13a PRIOR ART
FIGS. 13(*a*)–13(*c*) illustrate a prior art dome type switch.
Figure 13B:
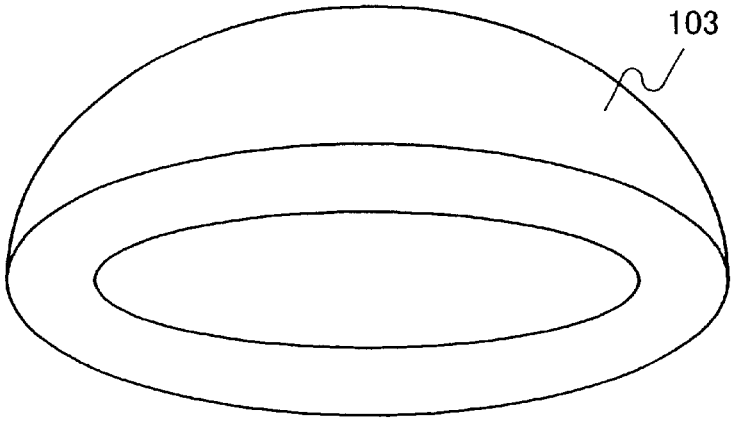
FIG.13b PRIOR ART
Figure 13C:
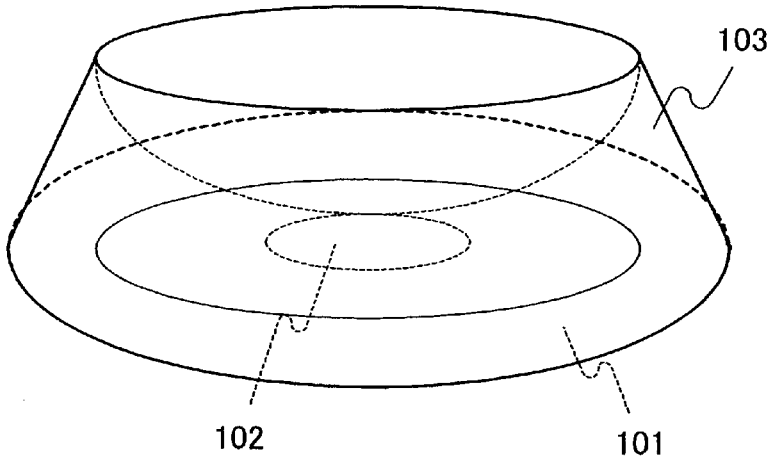
FIG.13c PRIOR ART
Figure 14:
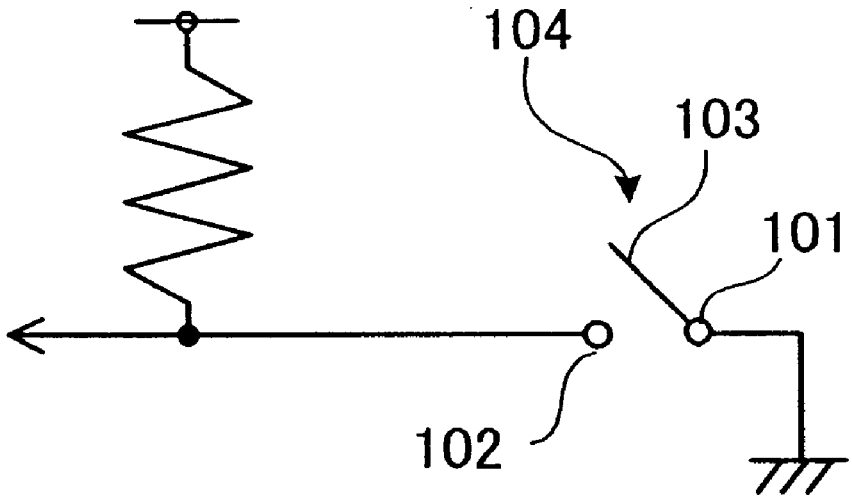
FIG. 14 PRIOR ART
FIG. 14 shows an equivalent circuit of the prior art dome type switch.

The embodiments shown in FIGS. 1 and 6 are expressions of the two extremes of the dome-like form. Forms intermediate between the semi-spherical shell-like three-dimensional form and the two-step frust-conical three-dimensional form are actually preferred. FIG. 11 shows a double-wall frust-conical three-dimensional form, which can be used in lieu of the two-step frust-conical three-dimensional form. FIG. 12 shows a two-step semi-spherical shell-like three-dimensional form, which can be used in lieu of the two-step frust-conical three-dimensional form. This example has a first partly spherical shell-like part 51, which is formed as outer three-dimensional continuous displacement part 3 and has a larger outer diameter, and a second partly spherical shell-like part 52, which is formed as inner three-dimensional continuous displacement part 4 and has a smaller outer diameter. The first partly spherical shell-like part 51 is integral with the second partly spherical shell-like part 52.

Electronic devices, particularly portable electronic devices, use a plurality of three-position displacement witch elements as described above, and the usefulness of these witches are revolutionarily improved. The two-switches shown in FIG. 3 are formed just like they apparently constitute a single switch in the planar view, and the movable part of the single switch is determined in comparison with the effective area. While the effective area of each of the two switches can not be reduced to one half, the area of a double-action switch can be reduced to one half of the sum area of two single-action switches. The double action hardly deteriorates the operability if it is a little bit accustomed to. The benefits of the size and weight reduction are greater than those of the better operability. The merits of the operability improvement owing to the reduction of the number of times of finger movement for changing the push-down position, are still beneficial even with demerits, as sacrifice, of the operability deterioration by the double action. The inter-electrode interval according to the present invention is one half the inter-electrode interval in the prior art. The technique of reducing the inter-electrode distance is free from any difficulty and its use in combination with the multiple layer wiring substrate permits area reduction of keyboards, switch groups and key groups of switching substrates and portable terminal electronic devices, which are small in size compared to the prior art and are the same in thickness as the prior art.

A single key and two well-known numeral keys are alike circuit-wise in view of the signal output performance. Shallow push-down of the single key corresponds to numeral "1", and deep push-down of the same key corresponds to numeral "2". In the prior art the number of numeral keys is 10. The key input device according to the present invention has five numeral keys, which have the following signal generation functions.

| Kind of key | Shallow push-down | Deep push-down |
|---|---|---|
| Numeral key "1, 2" | 1 | 2 |
| Numeral key "3, 4" | 3 | 4 |
| Numeral key "5, 6" | 5 | 6 |
| Numeral key "7, 8" | 7 | 8 |
| Numeral key "9, 0" | 9 | 0 |

The key input device according to the present invention has two function keys, which have the following signal generation functions.

| Kind of Key | Shallow push-down | Deep push-down |
|---|---|---|
| Function key "1, 2" | $f \cdot 1$ | $f \cdot 1 + f \cdot 2$ (= $f \cdot 3$) |
| Function key "2, 3" | $f \cdot 2$ | $f \cdot 2 + f \cdot 3$ (= $f \cdot 4$) |

These function keys are the same as the numeral keys noted above in that four signals can be generated with two keys. However, it is possible to start the function key "f 3" by making one deep push-down with the function key "1, 2" instead of making two shallow push-downs with the function keys "1, 2" and "3, 4" . Quick operation of the function keys is thus possible.

As has been described in the foregoing, the key input device and the portable terminal input device according to the present invention permit securing the property of linkwise transmission of reliable operation senses and reducing the number of keys.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the fore going description be regarded as illustrative rather than limiting.

What is claimed is:

1. A key input device comprising:

a wiring substrate; and a plurality of keys disposed on the wiring substrate and each having three-dimensional displacement surfaces capable of being displaced in a linked fashion relative to one another;

the three-dimensional displacement surfaces being:

a preceding displacement surface capable of undergoing a first displacement preceding in time; and a succeeding displacement surface capable of undergoing a second displacement subsequent in time to the first displacement of the preceding displacement surface;

the succeeding displacement surface being capable of undergoing the second displacement by a displacing force of the first displacement;

the plurality of keys each having:

a first key forming the preceding displacement surface; and a second key having the succeeding displacement surface;

a first switching operation being brought about when a first key part of the first key and a first substrate part of the wiring substrate are brought into mechanical contact with each other on the basis of displacement of the preceding displacement surface;

a second switching operation being brought about when a second key part of the second key and a second substrate part of the wiring substrate are brought into mechanical contact with each other on the basis of displacement of the succeeding displacement surface;

each of the keys executing the first and second switching operations by movement of its part perpendicular to the substrate surface of the wiring substrate; and the preceding and succeeding displacement surfaces each forming, before displacement, a convex surface in a direction opposite to the direction of the movement.

2. The key input device according to claim 1, wherein the first switching operation is brought about when the first key part and the first substrate part of the wiring substrate are brought into contact via the second key part with each other.

3. The key input device according to claim 2, wherein the first key, the wiring substrate and the second key together form a first closed space, and the second key and the wiring substrate together form a second closed space.

4. The key input device according to one of claims 2 and 3, wherein:

the wiring substrate has:

a first electrode fixedly bonded to the first key;

a second electrode fixedly bonded to the second key; and a third electrode facing the second closed space;

the first substrate part corresponding to the second electrode;

the second substrate part corresponding to the third electrode.

5. The key input device according to claim 4, wherein:

the first electrode forms a first closed ring, the second electrode forms a second closed ring, the first key has its entire circumference bonded to the first ring, the second key has its entire circumference bonded to the second ring, the first ring is electrically connected to GND (ground), the second ring is connected to a first input port of a CPU (central processing unit), and the third electrode is connected to a second input port of the CPU.

6. The key input device according to claim 4, wherein the first key has an electrically conductive first inner surface, the first inner surface is electrically connected to the first electrode, the second key has an electrically conductive second inner surface, the second inner surface is electrically connected to the second electrode.

7. The key input device according to claim 6, wherein:

the first key has:

a first body part made of a resin; and a first electrically conductive film formed on the inner side of the first body part:

the first inner surface corresponding to the inner surface of the first electrically conductive film; and the second key has:

a second body part made of a resin; and a second electrically conductive film formed on the inner side of the second body part;

the second inner surface corresponding to the inner surface of the second electrically conductive film.

8. The key input device according to claim 1, wherein the first and second keys are made of an electrically conductive metal.

9. The key input device according to one of claims 1, 2, 3 and 8, wherein:

the wiring substrate has a plurality of lead lines formed in its inside;

either one of the first to third electrodes being electrically connected via a connecting lead extending perpendicular to the wiring substrate to the wiring.

10. The key input device according to one of claims 1, 2, 3, and 8, wherein:

the first and second keys are both semi-spherical shell-like in form.

11. The key input device according to one of claims 1, 2, 3 and 8, wherein:

the first and second keys are both frust-conical in form.

12. The key input device according to claim 1, wherein:

the preceding and succeeding displacement surfaces form a continuous displacement surface, and the continuous displacement surface and the substrate surface of the wiring substrate form a single closed space.

13. The key input device according to claim 1, wherein:

the wiring substrate has:

a first lead line having a first disconnected part; and a second lead line having a second disconnected part;

the first and second key parts are both electrically conductive;

the first switching operation is brought about when the first key part is electrically coupled to the first disconnected part; and the second switching operation is brought about when the second key part is electrically coupled to the second disconnected part.

14. The key input device according to claim 13, wherein:

the first lead line has one side electrically connected to the ground and the other side connected to the first input port of the CPU; and the second lead line has one side electrically connected to the ground and the other side connected to the second input port of the CPU.

15. The key input device according to claim 14, wherein:

the first key has:

a first frust-conical form part having a larger outer diameter; and a first disk-like part integral with the first frust-conical form part and substantially parallel to the wiring substrate surface;

the second key has:

a second frust-conical form part having a smaller outer diameter; and a second disk-like part integral with the second frust-conical form part and substantially parallel to the wiring substrate surface;

the first disk-like part is integral with the second frust-conical form part; and the first key part is formed on the first disk-like part, and the second key part is formed on the second disk-like part.

16. The key input device according to claim 14, wherein:

the first key has:

a first partly spherical shell-like part having a larger outer diameter: and a second partly spherical shell-like part having a smaller outer diameter;

the first partly.spherical shell-like part being continuous to and integral with the second partly spherical shell-like part.

17. The key input device according to one of claims 12 to 16, wherein:

the first lead line has a first one side disconnected part formed in a first one side concave part and also has a first other side disconnected part formed in a first other side concave part, the first one side disconnected part having a portion extending in the first other side concave part, the first other side disconnected part having a portion extending in the first one side concave part; and the second lead line has a second one side disconnected part formed n a second one side concave part and also has a second other side disconnected part formed in a second other side concave part, the second one side disconnected part having a portion extending in the second one side disconnected part, the second other side disconnected part having a portion extending in the second one side concave part.

18. The key input device according to one of claims 13, 14, 15 and 16, wherein:

the surfaces of the first and second key parts are both smoothly curved surfaces.

19. The key input device according to claim 1, wherein:

the first switching operation is brought about when the first key part and the first substrate part of the wiring substrate are brought into contact via the second key part to each other, the first key, the wiring substrate and the second key together form a first closed space, the second key and the wiring substrate together form a second closed space;

the wiring substrate has:

a first electrode fixedly bonded to the first key; and a second electrode fixedly bonded to the second key;

the first substrate part corresponds to the first electrode:

the second substrate part corresponds to the third electrode; and the first electrode forms a first ring, the second electrode forms a second ring, the first key has the entire circumference bonded to the first ring, the second key has the entire circumference bonded to the second ring, the first ring is electrically connected to the GND, the second ring is connected to a first input port of a CPU, and the third electrode is connected to a second input port of the CPU.

20. The key input device according to claim 1, wherein:

the preceding and succeeding displacement surfaces together form an integral continuous displacement surface, the continuous displacement surface and the substrate surface of the wiring substrate together form a single closed space;

the wiring substrate has:

a first lead line having a first disconnected part; and a second lead line having a second disconnected part;

the first and second key parts are both electrically conductive;

the first switching operation is brought about when the first key part is electrically coupled to the first disconnected part, the second switching operation is brought about when the second key part is electrically coupled to the second disconnected part; and the first lead line has one side electrically connected to the GND and the other side connected to a first input port of a CPU, the second lead line has one side electrically connected to the GND and the other side connected to a second input port of the CPU; and the first key has a first inner surface, which is electrically conductive and is electrically connected to the first electrode, the second key has a second inner surface, which is electrically conductive and is electrically connected to the second electrode.

21. The key input device according to claim 20, wherein:

the first key has:

a first frust-conical form part having a larger outer diameter; and a first disk-like part integral with the first frust-conical form part and substantially parallel to the wiring substrate surface;

the second key has:

a second frust-conical form part having a smaller outer diameter; and a second disk-like part integral with the second frust-conical form part and substantially parallel to the wiring substrate surface;

the first disk-like part being continuous to and integral with the second frust-conical form part;

the first key part is formed on the first disk-like part, the second key part being formed on the second disk-like part.

22. The key input device according to claim 20, wherein:

the first key has:

a first partly spherical shell-like part having a later outer diameter; and a second partly spherical shell-like part having a smaller outer diameter; and the first partly spherical shell-like part is continuous to and integral with the second partly spherical shell-like part.

23. An input device for a portable terminal comprising:

a casing:

two CPU ports of a CPU, the CPU ports being fixedly disposed inside the casing:

a key group constituted by a plurality of keys as elements movably supported on the casing and forming the outer surface thereof; and a wiring substrate having a plurality of electrodes supported in the casing such as to be capable of being connected to the keys;

the keys are each capable of undergoing reciprocal movement having components perpendicular to the outer surface;

the keys are each capable of being brought into contact with the electrodes by two-step contact in a forward stroke in the perpendicular direction;

a second step contact of the two-step contact is a mechanically essential condition of a first step contact of the two-step contact; and the two-step contact switches the voltage states of the two input ports of the CPU in a linked fashion.

24. The input device for a portable terminal according to claim 23, wherein:

the keys each form a three-dimensional displacement surface capable of being displaced in a linked fashion;

the three-dimensional displacement surface has:

a preceding displacement surface capable of undergoing a first displacement preceding in time; and a succeeding displacement surface capable of undergoing a second displacement succeeding the first displacement of the preceding displacement surface and in a fashion mechanically linked to the first displacement;

the second displacement of the succeeding displacement surface is generated by a displacing force of the first displacement; and the keys each have:

a first key forming the preceding displacement surface; and a second key forming the succeeding displacement surface;

the first step contact being mechanical contact brought about between a first key part of the first key and a first electrode among the plurality of electrodes on the basis of displacement of the preceding displacement surface;

the second step contact being mechanical contact brought about between a second key part of the second key and a second electrode among the plurality of electrodes on the basis of displacement of the succeeding displacement surface.

25. The input device for a portable terminal according to one of claims 23 and 24, wherein:

the first step contact corresponds to numeral "j" of a numeral key, and the second step contact corresponds to numeral "j+1" of the numeral key.

26. The input device for a portable terminal according to claim 25, wherein:

if the minimum value of the numeral "j" is "0", the second step contact corresponds to an odd numeral of the numeral key.

27. The input device for a portable terminal according to one of claims 23 and 24, wherein:

the keys each have:

a first function key;

a second function key;

shallow push-down of the first function key causes start of a function f1;

shallow push-down of the second function key causes start of a function f2; and deep push-down of the first function key causes start of a function f3 corresponding to the shallow push-down of the first function key and the shallow push-down of the second function key.

* * * * *